US007896067B2

(12) United States Patent
Rayssiguier et al.

(10) Patent No.: US 7,896,067 B2
(45) Date of Patent: Mar. 1, 2011

(54) HYDRAULICALLY OPERATED PROTECTOR FOR DOWNHOLE DEVICES

(75) Inventors: Christophe Rayssiguier, Melun (FR); Jean-Philippe Bedel, Aberdeenshire (GB)

(73) Assignee: Schlumberger Technology Corporation, Sugarland, TX (US)

( * ) Notice: Subject to any disclaimer, the term of this patent is extended or adjusted under 35 U.S.C. 154(b) by 665 days.

(21) Appl. No.: 11/574,787

(22) PCT Filed: Aug. 24, 2005

(86) PCT No.: PCT/EP2005/009234

§ 371 (c)(1),
(2), (4) Date: Jan. 24, 2008

(87) PCT Pub. No.: WO2006/027120

PCT Pub. Date: Mar. 16, 2006

(65) Prior Publication Data

US 2008/0236835 A1 Oct. 2, 2008

(30) Foreign Application Priority Data

Sep. 10, 2004 (EP) ..... 04292174

(51) Int. Cl.
*E21B 23/04* (2006.01)

(52) U.S. Cl. ..... 166/241.6; 166/155; 166/242.7

(58) Field of Classification Search ..... 166/332.1, 166/334.1, 241.6, 242.7, 177.4, 187, 155, 166/156, 66

See application file for complete search history.

(56) References Cited

U.S. PATENT DOCUMENTS

| | | | | |
|---|---|---|---|---|
| 4,040,485 | A * | 8/1977 | Vann et al. | 166/297 |
| 4,089,548 | A | 5/1978 | Gurley | |
| 4,545,702 | A * | 10/1985 | Sano et al. | 405/269 |
| 6,315,041 | B1 | 11/2001 | Carlisle et al. | |

FOREIGN PATENT DOCUMENTS

| | | |
|---|---|---|
| GB | 2 360 055 | 9/2001 |

* cited by examiner

*Primary Examiner* — David J Bagnell
*Assistant Examiner* — David Andrews
(74) *Attorney, Agent, or Firm* — David Cate; Robin Nava; Jeff Griffin

(57) ABSTRACT

A tool and its operating procedure are provided to protect any device while lowering into a well, and especially hydraulic devices such as sensors with expandable arms or inflatable elements such as packers. The protection is mainly important in the open hole of highly deviated or horizontal wells, for any device equipped with external seal element, delicate sensor or articulated parts. This tool features an automatic sequence controlled by a single dart or a single ball launched into the running string from the surface: when the dart or the ball lands on its seat, the pressure build-up is initially applied to a piston to extract the device from the protector without exposing it to any differential pressure, then it is automatically applied to the device itself for actuation as soon as the device is entirely pulled out of the protector.

8 Claims, 6 Drawing Sheets

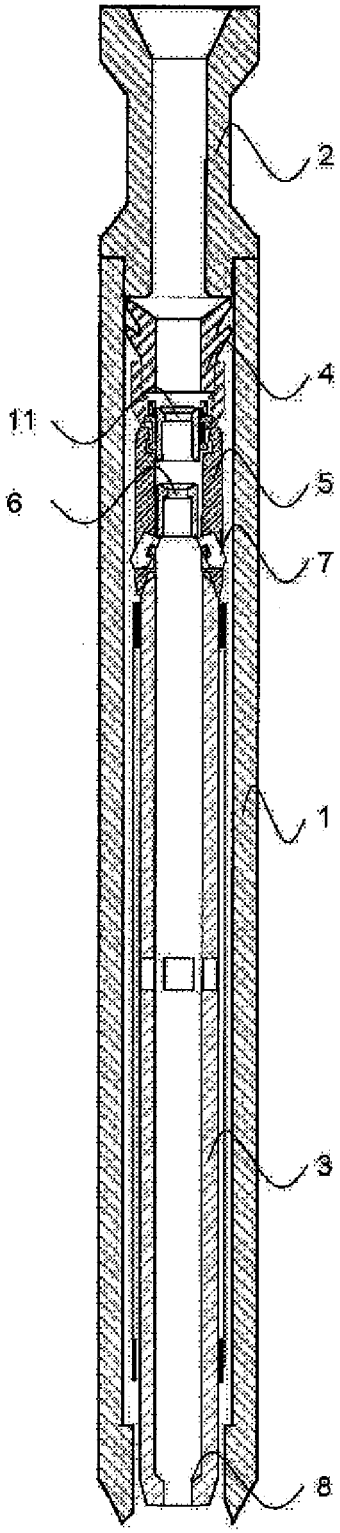
Figure 1-A
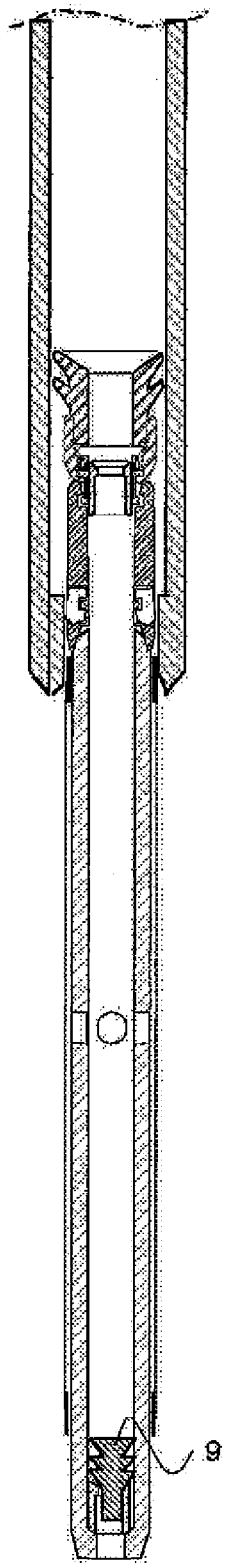
Figure 1-B

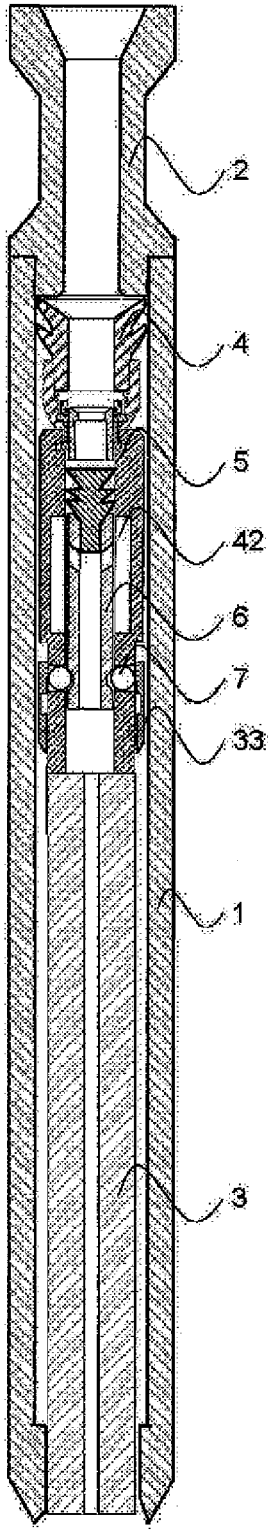
Figure 2-A
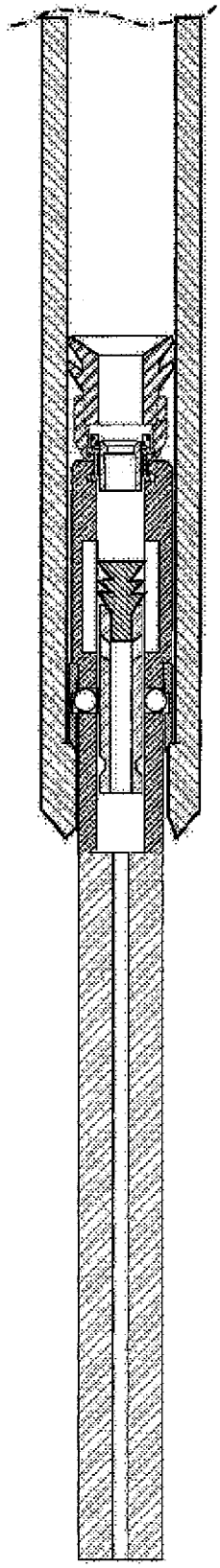
Figure 2-B

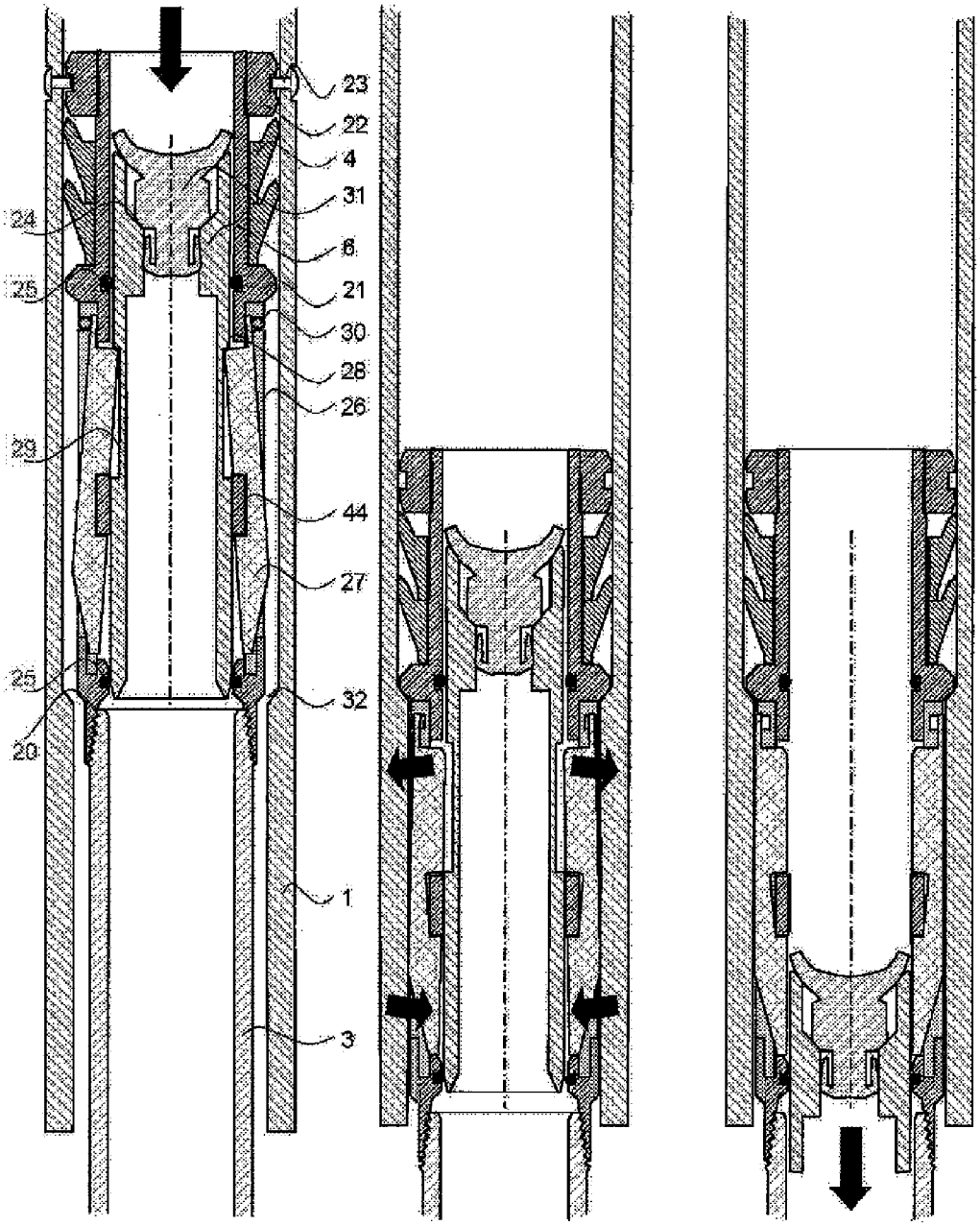
Figure 3-A Figure 3-B Figure 3-C

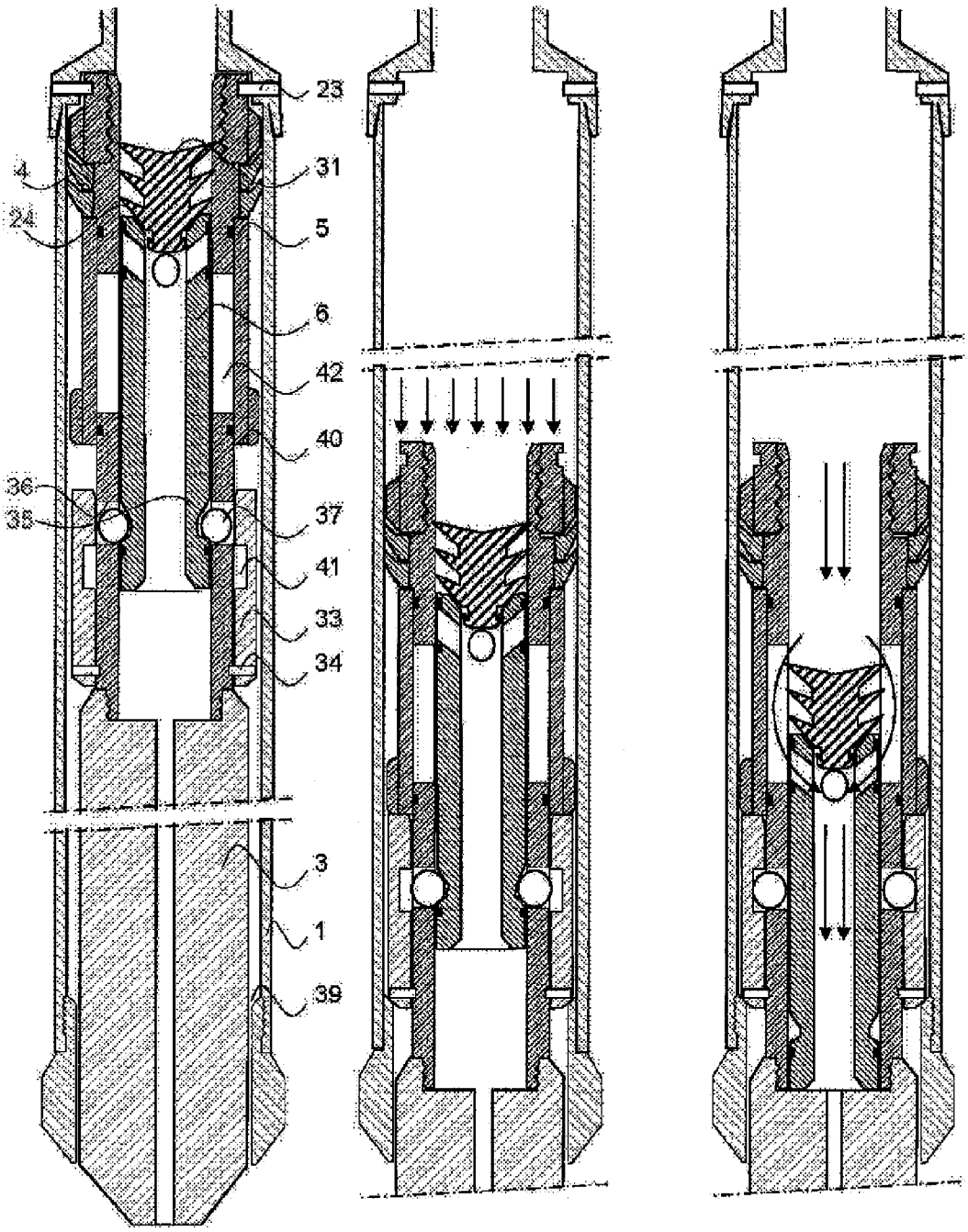
Figure 5-A Figure 5-B Figure 5-C

Figure 6-A
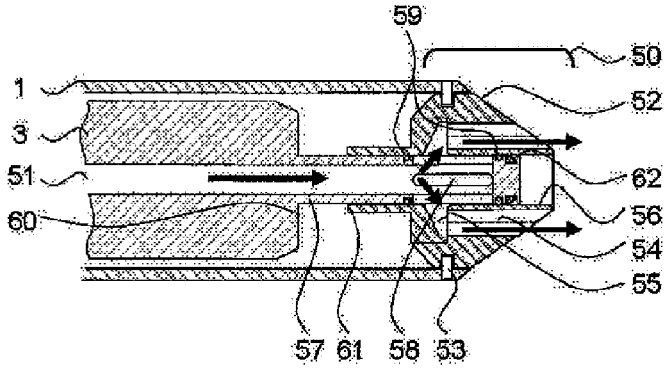
Figure 6-B
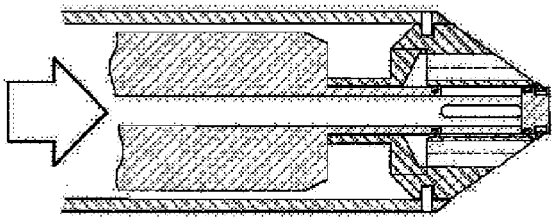
Figure 6-C
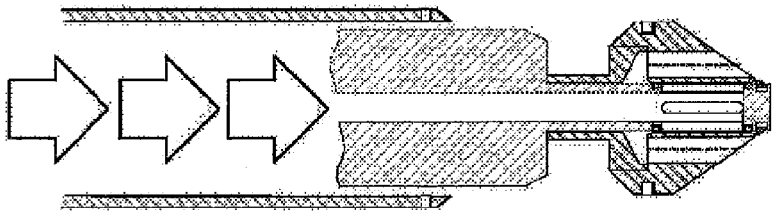

HYDRAULICALLY OPERATED PROTECTOR FOR DOWNHOLE DEVICES

FIELD OF THE INVENTION

The present invention relates to the field of downhole tools. More particularly the invention relates to servicing apparatus for completing downhole wells such as hydrocarbon wells.

BACKGROUND ART

In the art of well drilling, it is common practice to run multiple tools, often using conventional setting mechanisms. In cased wells, tool wearing by the casing is typically limited. However, in uncased wells, the borehole walls constitute highly abrasive surfaces that tend to damage the tools, in particular elements that are in contact with the borehole walls when running the tools that are typically folded away during placement operations and/or elements that are deflated such as packer, often made of rubber or other readily abraded materials.

Some types of cover sometimes protect the most sensitive parts of the tools but overall, the tools are left exposed to the aggressive wellbore environment, for example as in U.S. Pat. No. 6,315,041. This raised issues in particular with the development of horizontal or highly deviated wells where the tools may be literally dragged along the borehole. The risks of deteriorating a tool while handling it at surface should also not be neglected.

These issues are of particular concern with a technology consisting of placing a cement plug using a flexible, expandable form made for instance of a stretch fabric formed from steel, rubber, glass fiber, carbon fiber or para-aramid fiber, that holds the cement in place and thus allows rigorously correct placement. Since the mesh is necessarily loose to allow deformation, threads can easily get loose, thereby creating holes through which the cement slurry will escape.

Therefore, it would be desirable to provide some protecting means to tools until their proper placement in the well. It would also be desirable that the means for operating said protecting means be fully compatible with the tool operating means, in particular, does not require any additional power supply.

SUMMARY OF INVENTION

In a first aspect, the present invention proposes a protecting assembly consisting of a service tool including a tubular sheath for covering at least part of the device, for instance while the device is transferred from the surface down the hole. Abutting the upper extremity and disposed in the tubular sheath is a piston assembly that comprises a hydraulic piston with a tubular body and a dynamic seat translating along the tubular body. The hydraulic piston displaces the device between an upper position inside (or at least partly inside) the sheath and an active position outside the sheath. Means is also provided for preventing fluid circulation towards the device when the piston displaced it—and for reestablishing fluid circulation after extraction of the device out of the sheath.

In the above definition, the terms upper and lower actually respectively refer to the position along the borehole nearest and farthest to the surface (hence upper and lower position in a vertical well, though the invention is also applicable, and indeed particularly suitable, to horizontal or highly deviated wells).

The protecting means of the invention are fully compatible with hydraulically actuated devices, that is either moved or simply operated by a pressure build-up of wellbore fluids as this is the case for instance for a fluid activated packer where the fluid pressure expands an expandable body having a hollow interior to engage the inner wall of the casing or of the borehole.

Since both the protecting assembly and the hydraulic device are hydraulically actuated, it is crucial to prevent fluid circulation to the device during the device extraction. However, it is also important to resume such a circulation after the extraction. This problem is essentially solved thanks to the dynamic seat.

According to a first embodiment of the invention, the dynamic seat translates all along the device. This embodiment, also referred as "long-stroke" dynamic seat in the remaining part of the following description, is applicable when the device inside diameter is large enough for allowing the seat to travel through it, until the fluid can actuate the device. Optionally, the device may include a second seat, larger than the dynamic seat and located at the upper extremity of the device that can be used to disconnect the device from the protecting sheath.

According to another embodiment of the invention, also referred as "short-stroke" dynamic seat in the remaining part of the following description, the dynamic seat travels only along a short distance so that openings of the seats face by-pass slots provided in the tubular body so that fluid communication is possible when the seat is in its lower position. This embodiment is suitable whatever the diameter of the hydraulic device.

According to a preferred embodiment, the protecting device of the invention further includes locking means for preventing an accidental displacement of the dynamic seat, for instance to make the relative translation of the dynamic seat only possible once the piston has extracted the device out of the sheath.

In yet another preferred embodiment, means are provided for disconnecting the hydraulic device from the piston assembly so that the piston and the protecting sheath can be retrieved out of the well and refurbished for another operation.

The protecting service tool of the invention provides multiple benefits. The device is perfectly protected during surface transportation and installation. The system is fully operated by hydraulic pressure: no movement is required in the running string, which is especially suitable for horizontal or deviated wells. The actuation of the system can be controlled from the surface by using a single ball or dart, which greatly simplifies the operation (no volume calculation between darts, no need for a dart launcher, pumping is continuous . . . ).

The automatic sequence of events simplifies the operation and it eliminates the risk of human error. Moreover, the operation can be monitored from the surface by observing a specific pressure signature. The extraction of the device can be achieved at any pressure, as the device is not exposed to that pressure. The device is not exposed to any differential pressure before it is entirely pulled out of the protector. This is important because a prematurely actuation could prevent the correct extraction out of the protector and/or damage the device. Thus the system is compatible with hydraulic devices such as a bag made of woven material, an inflatable rubber element, or an articulated arm operated by pressure.

Other aspects and advantages of the invention will be apparent from the following description and the appended claims.

BRIEF DESCRIPTION OF DRAWINGS

The invention will now be described in greater detail with reference to the accompanying drawings, in which:

FIG. 1 is a schematic view of a protecting means according to the present invention with a long-stroke dynamic seat; represented with the tool in storing position (FIG. 1-A) and in active position outside the protect ting sheath (FIG. 1-B);

FIG. 2 is a schematic view of a protecting means according to the present invention with a short-stroke dynamic seat; represented with the tool in storing position (FIG. 2-A) and in active position outside the protecting sheath (FIG. 2-B);

FIG. 3 is a detailed view of the dynamic seat with locking means including pivoting keys represented in storing position (FIG. 3-A), pivoting (FIG. 3-B) and open to free the dynamic seat (FIG. 3-C);

FIG. 5 is a detailed view detailed view of the dynamic seat with a short stroke embodiment. The locking means includes a combination of balls and grooves, represented in storing position (FIG. 5-A), pushing out position (FIG. 5-B) and final position where the device is actuated (FIG. 5-C); and FIG. 6 is a schematic view of an automatic valve that preferably equipped a device protected according to the present invention in the short stroke embodiment.

DETAILED DESCRIPTION

Figure 4:
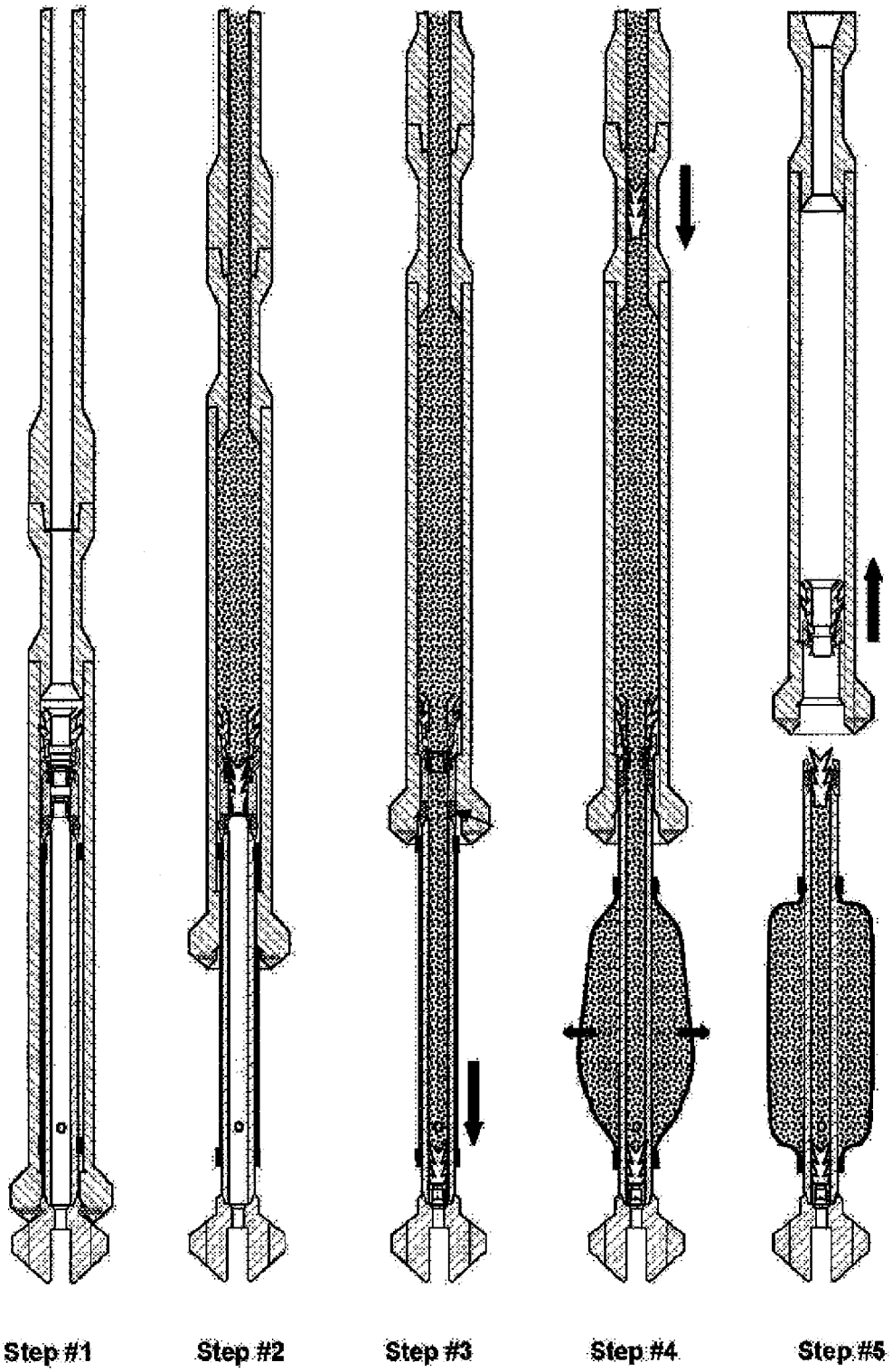
FIG. 4 is a schematic view illustrating some key steps of the operating sequence of the invention with a long-stroke embodiment.

The same references will be used to reference the same elements in the Figures throughout the description.

FIG. 1 is an illustration of a first embodiment of the present invention where the dynamic seat moves all along the protected device. As shown FIG. 1A, a tubular protective sheath 1 is secured, for instance through threading, at the bottom 2 of tubing, drill pipes, jointed pipes, coil tubing or other string of pipe known in the art. The dimensions of this sheath 1 are adjusted to entirely protect the device against shocks during transportation. Installation though sheaths ensuring only partial coverage may also be used in some cases. The sheath 1 is typically made of a strong material such as steel, for instance as a casing joint.

A hydraulically operated device 3 is stored inside the sheath. In this illustrated case, the protective sheath 1 extends all along the tool but it goes without saying that the invention may also be carried out with a protecting sheath covering only the upper part of the device 3.

To extract the protected device from its envelope, extracting means are provided. Said extracting means essentially consists of a piston assembly includes at least one piston seal 4 in contact with the sheath 1 so that the pressure in the running string can positively move the device out of the envelope; a connector 5, made of a tubular body; a dynamic seat 6 and seat locking means 7. In the illustrated case, the locking means 7 includes pivoting keys as it will be further detailed in relation with FIG. 3. Another seat stop 8 is located at the bottom of the hydraulically operated device.

The protective means according to the invention are operated as follows: the protected device 3 is downloaded into the well in the stored position. Flow circulation through the protective sheath 1 and the device 3 is allowed. Then, a ball 9 or a dart is pumped from the surface, lands onto the dynamic seat 6 and closes the flow path. This causes an increase of the pressure in the running string and the whole piston assembly is pushed towards the lower extremity of the protective sheath 3. During that stage, the dynamic seat 6 cannot be pushed out of the tubular body thanks to the seat keys 7. Once the piston assembly reaches the lower extremity of the sheath, as schematized FIG. 1B, the locking means 7 are unlocked to free the dynamic seat 6 that keeps moving along the device now fully extracted. The dynamic seat ends its course when blocked by the seat stop 8 so that the pressure can now be applied to the device itself to actuate it, without requiring an extra ball or dart.

If the inside diameter of the hydraulically operated device is not large enough for allowing the dynamic seat to travel through it, the embodiment schematized FIG. 2 may be used. This embodiment will be referred to as the short-stroke embodiment since the dynamic seat travels only the length of the tubular body. As illustrated FIGS. 2A and 2B, the whole service tool includes a tubular sheath 1 covering at least part of a downhole-actuated device 3 and a hydraulic piston to extract the device. The hydraulic piston includes at least one seal 4, a dynamic seat displaceable within a connector 5 and locking means 7.

In the present case, the locking means 7 is made of several linking elements (balls, keys, collet) secured by a sliding sleeve 33, but it goes without saying that the pivoting keys mentioned while describing the long-stroke embodiment could also be used, as the linking elements here described and further detailed in relation with FIG. 5 could be used in any embodiment.

The main difference with the later embodiment is the provision of by-pass slots 42 in the connector 5. The location of these slots is such that, once the ball or the dart 31 has landed on the seat, the fluid circulation is blocked as long as the dynamic seat is blocked by the locking means 7 and the fluid circulation is reestablished once the device has been entirely pushed out of the sheath and further progression of the dynamic seat has been made possible by the actuation of the locking means 7. In that case the bottom of the device must include a valve that automatically closes as soon as the device moves out of the envelope. An example of automatic valve that takes advantage of the device movement to close is described hereafter in relation with FIG. 6.

An additional landing seat 11, located on top of the connector may be optionally provided, to close the flow path again when a second ball or dart of larger dimension has landed on that seat, for instance for a surface monitoring of the system operation. Alternatively, it is also possible to provide a third position for the dynamic seat corresponding to that monitoring position.

An optional connector can be added to the system, so that the device can stay downhole while the protector is retrieved and reconditioned. A mechanical connector, such as shear pins, can be used. Alternatively, a hydraulic connector operated by a second ball or dart or when the pressure exceeds a given threshold, provides a convenient way to disconnect without applying tensile load or any physical movement on the device. Such connectors are well-known in the art of downhole tools.

FIG. 3 shows a detail of the piston assembly as used in the configuration represented FIG. 1 and in reference with FIG. 4, illustrates the implementation of the long-stroke dynamic seat embodiment. The piston assembly includes a piston body 5 having its lower extremity 20 screwed on the protected device 3. The piston assembly includes lateral stop means 21 and 22 that maintains the piston assembly centered within the protective sheath 1. In the initial storing position (FIG. 3-A and step #1 of FIG. 4), the piston assembly is held in position by shear pins 23 associated with the upper stop means 22 to prevent unwanted displacement of the piston assembly until a positive pressure is applied to it. Other latchable locking device, well known to those skilled in this art, can be used. A series of seals 4, located between the piston body 5 and the sheath 1 seal that annulus.

A dynamic seat 6, with an internal profile 24 to stop a ball or a dart 31, is positioned inside the piston body 5. To seal the annulus between the piston body 5 and the dynamic seat 6, a series of O-ring seals 25 may be provided.

Several slots 26 have been cut into the piston 5. These slots form pivots 44 and provide storing spaces for several pivoting keys 27. In the keys neutral position illustrated FIG. 3A, the shoulders 28 on the top of the keys are engaged in a groove 29 cut in the dynamic seat outside diameter, so that the seat 6 cannot translate downward as long as the keys 27 are in neutral position. That position is obtained by a spring 30, such as a Garter spring or an O-ring, located in a groove cut in the piston body. In this neutral position, the lower side of the keys is not flush with the body outside diameter in their extremity.

When a ball or a dart 31 is pumped down from the surface through the running string, it lands into the receiver profile 24. The dart is sealing the receiver inner path. As a consequence, the fluid cannot be pumped anymore and the pressure starts increasing on top of the dart, which creates a force pushing the dart and the receiver downward. The load is transmitted to the keys 27 and to the pivot point 44 of the piston. Consequently the piston assembly is pushed downward.

As illustrated FIG. 3-B and in step #2 of FIG. 4, when the force is high enough, the pins 23 that were securing the piston assembly inside the protector shear, and the whole internal assembly (device, lock, body, keys, receiver and dart) is pushed downward. The device 3 is thus moved outside the protecting sheath 1. At that moment no pressure is applied inside the device, so the device cannot be actuated. The load to actuate the piston can be very powerful, as the pressure applies on the full area of the sheath bore. So the system can work at any deviation, or even in horizontal wells.

In step #3 (FIG. 4), once the device is entirely located outside the protector, the lower extremities of the keys 27 engage inside a recess 32 provided near the lower extremity of the protecting sheath 1, which creates a torque and makes the keys 27 pivoting in their grooves. As a consequence, the key shoulders 28 are no longer engaged in the receiver groove 29, and the dynamic seat is free. On the other hand, the course of the piston body is blocked by the stop means 21 abutting the recess 32.

As shown FIG. 3-C, the pressure will now move the dynamic seat 6 and the dart 31 downward, until they stop against a recess cut in the Device, in such a position that the pressure will now be applied to the device 3 to actuate it; for example, an inflatable packer will inflate or the pumped cement inflates the cement bag as shown in step #4 of FIG. 4.

Optionally, as illustrated with step #5 of FIG. 4, the system includes a hydraulic connector between the device and the piston assembly. When the pressure rises above a given threshold, or when a second, larger dart lands inside the connector as illustrated, the connector is triggered and the device is disconnected from the protecting assembly, enabling its retrieval and refurbishing.

As mentioned before, the locking means that prevent the tail course of the dynamic seat can be made of pivoting keys as illustrated FIG. 3. Another alternative illustrated FIG. 5 includes the use of a series of balls and by-pass slots. This figure also illustrates details of the short-stroke embodiment where the main difference with the long-stroke dynamic seat is that the second position of the dynamic seat is located in front of by-pass slots, so that the pressure can be applied to the device after a very short stroke of the seat. This design reduces the risk of being stuck in the middle of a long stroke, and it is mandatory for any device with no or insufficient path for the dart.

The piston assembly includes a tubular body sliding within a sleeve 33 and a dynamic seat 6. During transport, upper shear pins 23 prevent displacement of the piston assembly relative to the protective sheath 1 and lower shear pins 34 prevent displacements relative to the sleeve 33 until a dart 31 is pumped, lands on the receiver 24 of the dynamic seat 6 so that the assembly is sealed, pressure is applied to the full area of the seal and the load on the whole assembly is high enough to shear the upper pins 23 (FIG. 5-A). At its lower extremity, the dynamic seat includes a ramp 35. In the storing position illustrated FIG. 5-A, this ramp 35 faces a window 36 made in the part of the tubular body already engaged in the sleeve so that it forms housings for several balls 37 wedged laterally between the sleeve 33 and the ramp 35 and vertically by the tubular body. The combination of ramps, windows and balls forms a locking devices that blocks movement of the dynamic seat relative to the piston body.

As illustrated FIG. 5B, the whole internal assembly (formed by the tubular body 5, the dynamic seat and the sleeve) acts as a piston and it translates inside the protective sheath 1. At that stage, the pressure above the assembly is not applied to the device because the dart is sealing the bore of the body 5. Thus the device cannot be actuated yet.

When the device is entirely located outside the protector, the external sleeve 33 stops against the recess 39 at the bottom extremity of the protector. The inertia of the assembly or the pressure load will shear the lower pins 34 that were securing the sleeve 33 on the body 5. Once the pins are sheared, the body 5 can translate slightly further until its shoulder 40 stops against the sleeve 33. In that position illustrated FIG. 5-B, the balls 37 are located in front of a groove 41 cut in the inside diameter of the sleeve 33.

The ramp 35 cut in the dynamic seat 6 can now push the balls 37 into the groove 41, freeing the dynamic seat (FIG. 5-B). Thanks to the pressure load, the dynamic seat 6 and the dart 31 move downward to the second position (FIG. 5-C). The dart 31 is now located in front of slots 42 cut in the body 5. That means the dart fins 43 are still compressed but the fluid can by-pass the dart and circulate through the slots 42 down to the device 3. So the device 3 will now be actuated. Its actuation can only occur when it was entirely located outside the protector.

It is worth noting that the two proposed locking means (keys or balls and groves) are not sensitive to the possible shocks that can occur if the dart lands violently.

According to a preferred embodiment, the device is equipped with an automatic valve, located that closes when the device starts moving out. Once the valve is closed, the pressure can raise inside the device to actuate it. An example of such a valve is illustrated FIG. 6.

A valve assembly 50 is secured to the lower extremity of a device 3 including an internal flow path 51, so that it closes the lower extremity of the protective sheath 1. The valve assembly includes a lower bushing 52, pinned at the extremity of the sheath using shear pins 53 that secure the device within the sheath in the open position illustrated FIG. 6-A corresponding to the storing position. Several flowing bushing ports 54 are drilled though the bushing 52 and they communicate with an annular chamber 55. The inside diameter of the bushing is a seal bore 56, where a sleeve 57, with ports 58 can slide. The sleeve 57 includes seals 59 located on each side of the sleeve ports 58.

The sleeve 57 is connected at the lower extremity of the device flow path 51, so its location inside the bushing bore is defined by the device itself. The design can accommodate a rather large tolerance because the ports have an oblong geometry. In the storing position illustrated FIG. 6-A, the device is retracted inside the sheath and the sleeve ports are located in front of the bushing annular chamber, so the valve is open.

FIG. 6-B corresponds to the beginning of the device extraction. The sleeve 57 translates through the bushing bore 56 until the device shoulder 60 stops against the bushing extremity 61. At that moment all seals 59 are engaged in the seal bore 56 of the bushing 52, closing the sleeve ports. In addition, an expanding ring 62 slightly expands below the bushing, preventing any backward movement and locking the valve in closed position.

Once a sufficient load is applied on the piston assembly, as illustrated FIG. 6-C, the pins 53 that were securing the bushing on the sheath are sheared, and the bushing can now move out of the envelope with the device, and the valve stays closed.

This unique combination of the invention allows free circulation of the fluid through the device during installation. Once a dart or a ball lands on the dynamic seat, the device is hydraulically extracted from the sheath without being exposed to the pressure and the automatic valve closes the flow path at the extremity of the device. Then, automatically when the device is entirely deployed out of the sheath, it is exposed to the hydraulic pressure that will actuate it. The whole sequence is entirely automatic for an easy and safe operation, and it can be initiated from the surface at any moment by pumping down a single dart or ball.

The invention claimed is:

1. A service tool for a hydraulically actuated downhole device including a tubular sheath for covering at least part of the device when the device is run into a wellbore; and a piston assembly disposed in the tubular sheath, abutting the upper extremity of the device, said assembly including:

a hydraulic piston, said piston to displace the device between an upper position where the sheath covers at least part of the device and a lower position where the device is essentially outside the sheath; and said piston including a tubular body and a dynamic seat translating along said tubular body;

means for preventing fluid circulation into the device while the piston is displacing said device and reestablishing circulation when the device is outside the sheath;

wherein the tubular body includes locking means to prevent translation of the dynamic seat as long as the piston is not in its lower position.

2. The service tool according to claim 1, further including a locking device to secure the piston assembly in the upper position while the service tool is run down the well.

3. The service tool according to claim 2, wherein said locking device includes shearing pins.

4. The service tool according to claim 1, wherein said locking means are deactivated when the piston assembly abuts a recess located in the vicinity of the lower extremity of the tubular sheath.

5. The service tool according to claim 1, wherein the dynamic seat includes at least one fluid flow path and the tubular body includes at least one by-pass slot so that fluid communication is achieved when the dynamic seat is translated to face the by-pass slots.

6. A service tool for a hydraulically actuated downhole device including a tubular sheath for covering at least part of the device when the device is run into a wellbore; and a piston assembly disposed in the tubular sheath, abutting the upper extremity of the device, said assembly including:

a hydraulic piston, said piston to displace the device between an upper position where the sheath covers at least part of the device and a lower position where the device is essentially outside the sheath; and said piston including a tubular body and a dynamic seat translating along said tubular body;

means for preventing fluid circulation into the device while the piston is displacing said device and reestablishing circulation when the device is outside the sheath;

a locking device to secure the piston assembly in the upper position while the service tool is run down the well;

wherein the tubular body includes locking means to prevent translation of the dynamic seat as long as the piston is not in its lower position.

7. The service tool according to claim 6, wherein said locking means are deactivated when the piston assembly abuts a recess located in the vicinity of the lower extremity of the tubular sheath.

8. The service tool according to claim 7, wherein said locking means includes a sliding sleeve with a groove, said sliding sleeve in downwards movement with the piston until it abuts the recess and the dynamic seat includes a ramp housing, at least one ball, said ball blocking the relative translation of the dynamic seat as long as the piston is not lowered to a position in which the groove and the ramp are in communication, allowing the ball to get out of the way of the dynamic seat.

* * * * *